US010081024B1

(12) United States Patent
Hong

(10) Patent No.: US 10,081,024 B1
(45) Date of Patent: Sep. 25, 2018

(54) DESK TYPE LIQUID CHEMICAL SPRAYING DEVICE

(71) Applicant: SMBURE CO., LTD., Gwangju (KR)

(72) Inventor: Gi Sool Hong, Gwangju (KR)

(73) Assignee: SMBURE CO., LTD., Gwangju (KR)

( * ) Notice: Subject to any disclaimer, the term of this patent is extended or adjusted under 35 U.S.C. 154(b) by 0 days.

(21) Appl. No.: 15/608,883

(22) Filed: May 30, 2017

(30) Foreign Application Priority Data

Mar. 15, 2017 (KR) ..... 10-2017-0032423

(51) Int. Cl.

| | |
|---|---|
| ***B05B 15/00*** | (2018.01) |
| ***B05B 1/16*** | (2006.01) |
| ***B65D 47/06*** | (2006.01) |
| ***B05B 1/34*** | (2006.01) |
| ***B05B 11/00*** | (2006.01) |
| ***B05B 15/555*** | (2018.01) |
| *B05B 1/14* | (2006.01) |
| *B05C 1/00* | (2006.01) |

(52) U.S. Cl.
CPC ..... *B05B 1/1645* (2013.01); *B05B 1/341* (2013.01); *B05B 11/3057* (2013.01); *B05B 15/555* (2018.02); *B65D 47/061* (2013.01); *B05B 1/14* (2013.01); *B05C 1/006* (2013.01)

(58) Field of Classification Search
CPC ..... B05B 1/1645; B05B 1/341; B05B 1/14; B05B 3/025; B05B 5/04; B05B 11/3057; B05B 11/10; B05B 11/0005; B05B 15/0258; B05B 15/555; B65D 47/061
USPC ..... 239/550, 220, 240, 481, 302, 152, 153, 239/154; 222/478, 482, 484, 485, 222/504–508, 544–548, 566
See application file for complete search history.

(56) References Cited

U.S. PATENT DOCUMENTS 564,021 A * 7/1896 Mamaux et al. ..... B05B 7/2408 141/112
1,657,013 A * 1/1928 Kettle ..... F16L 37/00 141/312
2,223,012 A * 11/1940 Wanderski ..... B67D 1/0802 222/400.7
2,453,416 A * 11/1948 Dom ..... F16K 31/12 236/92 R
2,789,011 A * 4/1957 Gebauer ..... B65D 47/0866 239/302
2,883,511 A * 4/1959 Gooldy ..... F24D 5/00 122/4 R
2,978,185 A * 4/1961 Pearch ..... A01M 7/0014 138/45

(Continued)

FOREIGN PATENT DOCUMENTS

KR 20-0197479 Y1 9/2000
KR 10-2010-0009157 A 1/2010

(Continued)

*Primary Examiner* — Viet Le

(57) ABSTRACT

A desk type liquid chemical spraying device, or a desk type liquid chemical spraying device, sprays a liquid chemical in a wide range. The spraying device includes a plurality of nozzles for spraying the liquid chemical to an upper side of a spraying case through a nozzle structure and spraying the liquid chemical to four sides while a nozzle structure is rotated so that the liquid chemical spraying device may be located in a flat place such as a ground surface or a desk.

15 Claims, 6 Drawing Sheets

(56) References Cited

U.S. PATENT DOCUMENTS 2,995,307 A * 8/1961 McMahon ..... A01M 7/0053 239/124
3,565,342 A * 2/1971 Orem ..... B05B 3/02 239/227
3,940,065 A * 2/1976 Ware ..... B05B 5/085 239/146
4,114,647 A * 9/1978 Sturman ..... A01G 25/167 137/624.2
4,121,767 A * 10/1978 Jensen ..... A01M 7/0092 137/92
4,278,132 A * 7/1981 Hostetter ..... A62C 5/00 137/897
4,784,329 A * 11/1988 Heren ..... B05B 3/0422 239/247
6,345,640 B1 * 2/2002 Newberg ..... F16K 41/103 137/15.05
6,409,093 B2 * 6/2002 Ulczynski ..... A01M 1/2016 222/399
6,540,155 B1 * 4/2003 Yahav ..... B65D 83/262 239/573
6,561,437 B1 * 5/2003 Schulman ..... A01C 23/006 239/302
7,178,740 B2 * 2/2007 Williams ..... B05B 7/0846 239/10
7,306,167 B2 * 12/2007 Colarusso ..... A01G 13/06 137/78.1
7,455,246 B2 * 11/2008 Roth ..... B08B 3/026 222/609
7,500,581 B2 * 3/2009 O'Leary ..... B67B 7/24 222/1
7,500,584 B2 * 3/2009 Schutz ..... A61C 17/02 222/464.5
7,507,299 B2 * 3/2009 Wadsworth ..... A61L 2/18 134/22.12
7,992,809 B1 * 8/2011 Barnett ..... B05B 7/0416 222/190
8,430,337 B2 * 4/2013 Pearce, III ..... A01G 13/06 239/457
8,839,994 B2 * 9/2014 Mason ..... B65D 83/303 222/402.1
9,731,330 B1 * 8/2017 Kane ..... B08B 3/02
2004/0016824 A1 * 1/2004 Kawamoto ..... B08B 3/026 239/302
2004/0084552 A1 * 5/2004 Huartson ..... A01M 7/0039 239/146
2004/0118940 A1 * 6/2004 Lavitt ..... A01G 25/145 239/302
2004/0118942 A1 * 6/2004 Courtney ..... A45F 3/20 239/302
2004/0227013 A1 * 11/2004 Byron ..... B05B 9/0816 239/337
2004/0237561 A1 * 12/2004 Duarte Barreto Junior ..... B60H 1/3233 62/285
2004/0245355 A1 * 12/2004 Fettig ..... B05B 7/2489 239/302
2005/0040254 A1 * 2/2005 Chang ..... B05B 1/14 239/302
2005/0067509 A1 * 3/2005 Redaelli ..... B65D 83/20 239/548
2005/0211796 A1 * 9/2005 Lovett ..... A01M 1/2038 239/332
2005/0224596 A1 * 10/2005 Panopoulos ..... A01M 1/2038 239/67
2005/0274824 A1 * 12/2005 Brooke ..... A01G 31/02 239/398
2005/0279865 A1 * 12/2005 Thomason ..... B05B 7/16 239/526
2005/0284951 A1 * 12/2005 Clarke, III ..... B05B 7/2416 239/8
2006/0027680 A1 * 2/2006 Wu ..... B05B 9/0861 239/302
2006/0086821 A1 * 4/2006 Junkel ..... A45F 3/16 239/302
2006/0086824 A1 * 4/2006 Pearce, III ..... A01G 13/06 239/337
2006/0144971 A1 * 7/2006 Nakada ..... A61L 9/145 239/690
2007/0023544 A1 * 2/2007 Woods ..... A62C 13/62 239/302
2007/0029406 A1 * 2/2007 Chen ..... B05B 9/0861 239/302
2007/0114302 A1 * 5/2007 Wu ..... B05B 9/0861 239/329
2007/0164133 A1 * 7/2007 Lin ..... A61M 5/3007 239/525
2007/0272767 A1 * 11/2007 Niggemann ..... B65D 83/20 239/337
2007/0278326 A1 * 12/2007 Wu ..... B05B 9/0861 239/302
2008/0279730 A1 * 11/2008 Triplett ..... A01M 1/2033 422/123
2008/0283624 A1 * 11/2008 Sawalski ..... B05B 1/14 239/1
2010/0001099 A1 * 1/2010 Onda ..... B05B 1/3026 239/302
2011/0042487 A1 * 2/2011 Cai ..... A01G 25/145 239/332
2011/0132998 A1 * 6/2011 Marzio ..... B05B 11/0032 239/288
2011/0163183 A1 * 7/2011 Ko ..... B05B 11/06 239/302
2011/0315788 A1 * 12/2011 Henderson ..... A01M 7/0046 239/152
2012/0056016 A1 * 3/2012 Fritsch ..... B05B 11/0037 239/302
2013/0008978 A1 * 1/2013 Smith ..... B05B 7/2424 239/302
2013/0056558 A1 * 3/2013 Chen ..... B05B 3/06 239/302
2013/0079733 A1 * 3/2013 Burt ..... B05B 7/0012 604/290
2013/0153683 A1 * 6/2013 Lawrence ..... B05B 7/2408 239/302
2013/0206866 A1 * 8/2013 Bullock ..... A61M 11/02 239/302
2014/0008461 A1 * 1/2014 Shiun ..... B05B 7/0075 239/302
2014/0061333 A1 * 3/2014 Hao ..... F01N 3/2066 239/302
2014/0252125 A1 * 9/2014 Mastrovito ..... B05B 1/14 239/302
2014/0263740 A1 * 9/2014 Esaki ..... A61M 11/06 239/302
2014/0263744 A1 * 9/2014 Ulledahl ..... A23P 30/00 239/373
2014/0312142 A1 * 10/2014 Lovett ..... B05B 9/0403 239/146
2014/0346248 A1 * 11/2014 Huber ..... A01M 7/0092 239/71
2015/0144714 A1 * 5/2015 Pirtle ..... B05B 11/0008 239/302

FOREIGN PATENT DOCUMENTS

KR 10-1286801 B1 7/2013
KR 10-1499749 B1 3/2015
KR 20-0478646 Y1 11/2015

* cited by examiner

DESK TYPE LIQUID CHEMICAL SPRAYING DEVICE

CROSS-REFERENCE TO RELATED APPLICATIONS

A claim for priority under 35 U.S.C. § 119 is made to Korean Patent Application No. 10-2017-0032423 filed on Mar. 15, 2017, in the Korean Intellectual Property Office, the entire contents of which are hereby incorporated by reference.

BACKGROUND

Embodiments of the inventive concept described herein relate to a desk type liquid chemical spraying device, and more particularly to a desk type liquid chemical spraying device that may spray a liquid chemical more easily in a wide range by installing a plurality of nozzles for spraying the liquid chemical to the upper side of a spraying case through a nozzle structure and spraying the liquid chemical to four sides while a nozzle structure is rotated so that the liquid chemical spraying device may be located in a flat place such as a ground surface or a desk.

In general, a liquid chemical spraying device refers to a device for ejecting a liquid material having a chemical property mainly including water through a pressure, and various principles of ejecting the liquid chemical of the liquid chemical spraying device are employed and used.

The most basic method of the above-mentioned liquid chemical spraying device has an advantage of spraying a uniform amount of a liquid chemical in a manner in which the liquid chemical is directly pumped by a pump and is ejected by a nozzle at an end of the liquid chemical spraying device, but has a difficulty in ejecting a fine amount of a liquid chemical and ejecting the liquid chemical in a wide area.

Further, other methods of the above-mentioned liquid chemical spraying device may include a manner in which a liquid chemical in the interior of a liquid chemical tank is suctioned by a pressure difference between the liquid chemical and air passing through a Venturi pipe at a high speed and is ejected together with air, but in this case, the ratio of the liquid chemical suctioned and ejected together with air is not constant and cannot be easily adjusted by the user.

Meanwhile, in cattle sheds in which livestock is raised, germicides or insecticides are normally or periodically diluted in water at a specific concentration for disinfection or fumigation to be ejected or sprayed.

Further, even when agricultural products are cultivated in vinyl houses regardless of seasons, liquid chemicals including agricultural chemicals, such as pesticides or nutrients are continuously ejected through the whole year to improve productivity.

However, because the pesticide operation for agricultural products in livestock or vinyl houses includes ejecting a liquid chemical while the user carries a heavy sprayer in a manual case, the operation becomes troublesome and time-consuming. In particular, in the summer season, because the temperature of the interior of the vinyl house become higher, the disinfection operation of the user may be troublesome.

Further, as described above, when the operator performs a spraying operation while carrying a tank in which a liquid chemical is stored, the operator may feel physical fatigues and the operation time may become longer.

In addition, according to the conventional technology, because the operator has to eject a liquid chemical while carrying the sprayer having an ejection nozzle, the liquid chemical may penetrate into the human body through skin or respiratory organs of the operator, poisoning the human body.

PRIOR TECHNICAL DOCUMENTS

Patent Documents

Korean Patent Application Publication No. 2014-133696 (published on Nov. 20, 2014)

Korean Patent Application Publication No. 10-1286801 (published on Jul. 17, 2013)

Korean Patent Application Publication No. 2010-0009157 (published on Jan. 27, 2010)

Korean Utility Model Application Publication No. 20-0478646 (published on Nov. 2, 2015)

Korean Utility Model Application Publication No. 20-0197479 (published on Sep. 15, 2000)

SUMMARY

Embodiments of the inventive concept provide a desk type liquid chemical spraying device that may spray a liquid chemical more easily in a wide range by installing a plurality of nozzles for spraying the liquid chemical to the upper side of a spraying case through a nozzle structure and spraying the liquid chemical to four sides while a nozzle structure is rotated so that the liquid chemical spraying device may be located in a flat place such as a ground surface or a desk.

In addition, embodiments of the inventive concept also provide a desk type liquid chemical spraying device that may prevent a liquid chemical from penetrating into the human body through skin or respiratory organs, positioning the human body, by installing a plurality of nozzles for spraying a liquid chemical to the upper side of a spraying case through a nozzle structure and spraying the liquid chemical to four sides while a nozzle structure is rotated to interrupt an influence of the liquid chemical on the human body.

The embodiments of the inventive concept also provide a desk type liquid chemical spraying device that may automatically eject a liquid chemical in a specific range for easier pesticides, control of pests or disinfection by installing a plurality of nozzles on the upper side of a spraying case through a nozzle assembly and spraying a liquid chemical to four sides while a nozzle structure is rotated.

In accordance with an aspect of the inventive concept, there is provided a desk type liquid chemical spraying device, including a spraying case in which a liquid chemical container for storing a liquid chemical is provided in the interior thereof and having a flat bottom surface such that the spraying case is seated in a flat place, a fixing support member integrally formed with one side of an upper part of the spraying case and having an open-topped structure, a rotation support member fixedly installed through an upper part of the fixing support member and having an open-topped and an open-bottomed tubular structure, an open-topped and an open-bottomed nozzle installation member having an inner race gear installed on an upper side of the rotation support member to be rotatable and formed on an inner peripheral surface of a lower side of the nozzle installation member and a plurality of nozzle coupling holes formed on an outer peripheral surface of an upper part of the nozzle installation member, a driving motor fixedly installed on an inner side of the rotation support member and in which a driving gear enmeshed with the inner race gear of the nozzle installation member is provided on a driving shaft, a liquid chemical supply hose coupling member fixedly installed on an inner peripheral surface of the nozzle installation member through supports of 3 points or more and having a vertical hose coupling hole at the center thereof, a liquid chemical supply hose inserted into the hose coupling hole of the liquid chemical supply hose coupling member through the fixing support member of the spraying case and coupled to an inner peripheral surface of the hose coupling hole by a bearing coupled onto an outer peripheral surface of an upper end thereof, a liquid chemical branch member coupled and fixed to an upper end of the hose coupling hole of the liquid chemical hose coupling member, forming a space between the liquid chemical branch member and an upper end of the liquid chemical supply hose, and in which a plurality of branch holes corresponding to the number of the nozzle coupling holes vertically pass through the liquid chemical branch member, a plurality of liquid chemical ejecting nozzles detachable coupled to the nozzle coupling holes of the nozzle installation member, respectively, to spray a liquid chemical, and a plurality of liquid chemical branch hose for supplying a liquid chemical to the liquid chemical ejecting nozzles from the branch holes of the liquid chemical branch members, respectively.

The desk type liquid chemical spraying device may further include a carrying handle allowing a user to grip one side of an upper part of the spraying case to carry the desk type liquid chemical spraying device.

The desk type liquid chemical spraying device may further include a cover cap installed at an upper end of the nozzle installation member to cover an opening structure.

The liquid chemical ejecting nozzle may include a bent nozzle tubular body, a coupling hook formed at one end of the nozzle tubular body and detachably coupled onto the corresponding nozzle coupling hole of the nozzle installation member, and a nozzle cap screw-coupled to an opposite end of the nozzle tubular body and having a nozzle configured to spray a liquid chemical at the center thereof.

The bearing coupled onto an outer peripheral surface of an upper end of the liquid chemical supply hose may be configured to rotate the nozzle installation member about the liquid chemical supply hose that is fixedly installed.

The liquid chemical ejecting nozzle may spray a liquid chemical in a horizontal direction of a vertical upper rotor by vertically adjusting an angle of the liquid chemical ejecting nozzle.

The liquid chemical in a liquid chemical container in the interior of the spraying case may be supplied by a blower configured to supply the liquid chemical through a pneumatic pressure or a pump configured to supply the liquid chemical through pumping.

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Hereinafter, a desk type liquid chemical spraying device according to an embodiment of the inventive concept will be described in detail with reference to the accompanying drawings.

Figure 1:
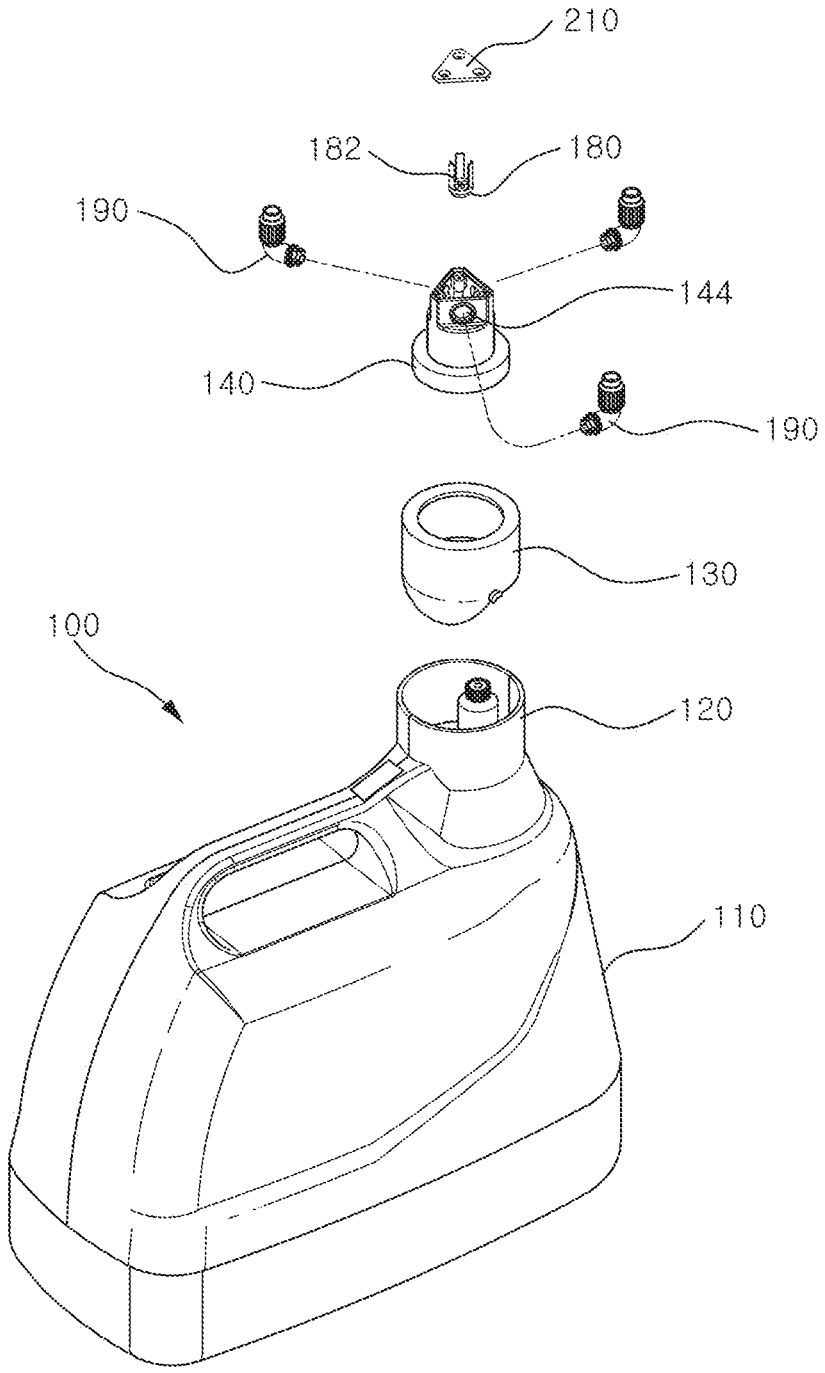
FIG. 1 is an exploded perspective view illustrating a desk type device for spraying a liquid chemical according to the inventive concept.
Figure 2:
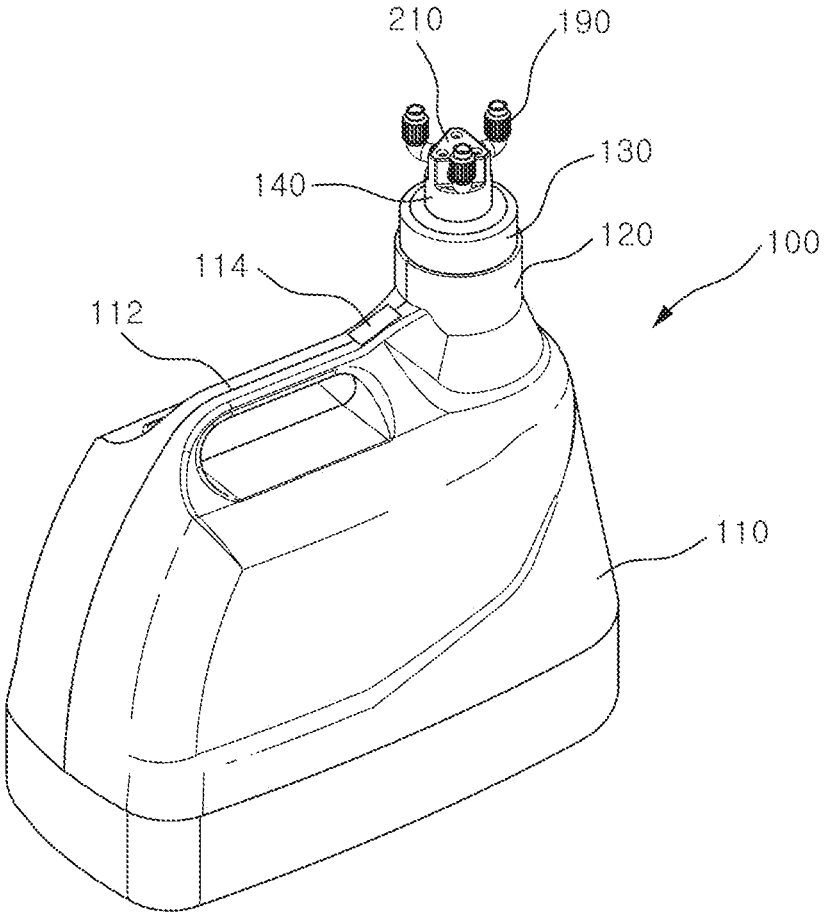
FIG. 2 is a perspective view illustrating the desk type device for spraying a liquid chemical according to the inventive concept.
Figure 3:
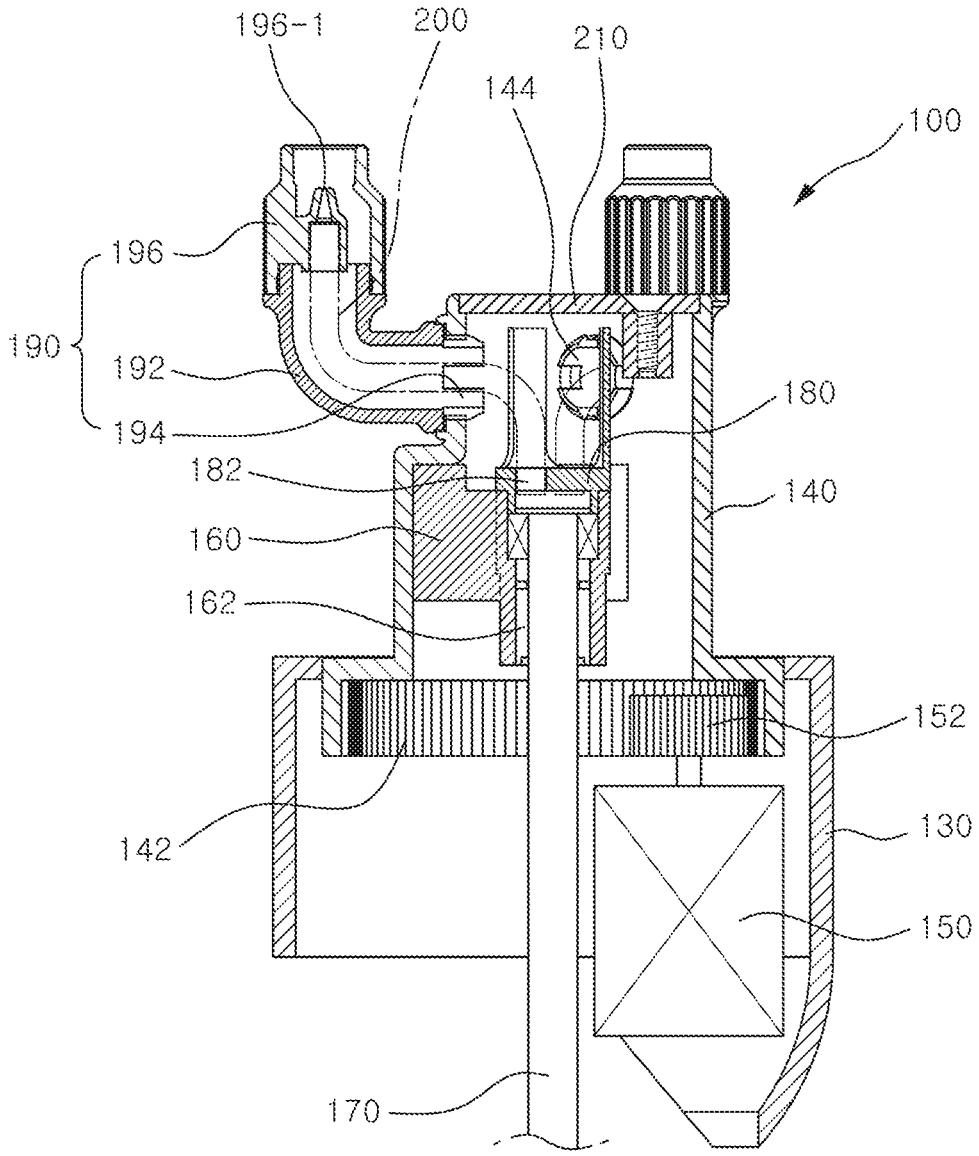
FIG. 3 is a longitudinal sectional view illustrating a nozzle structure of the desk type device for spraying a liquid chemical according to the inventive concept.
Figure 4:
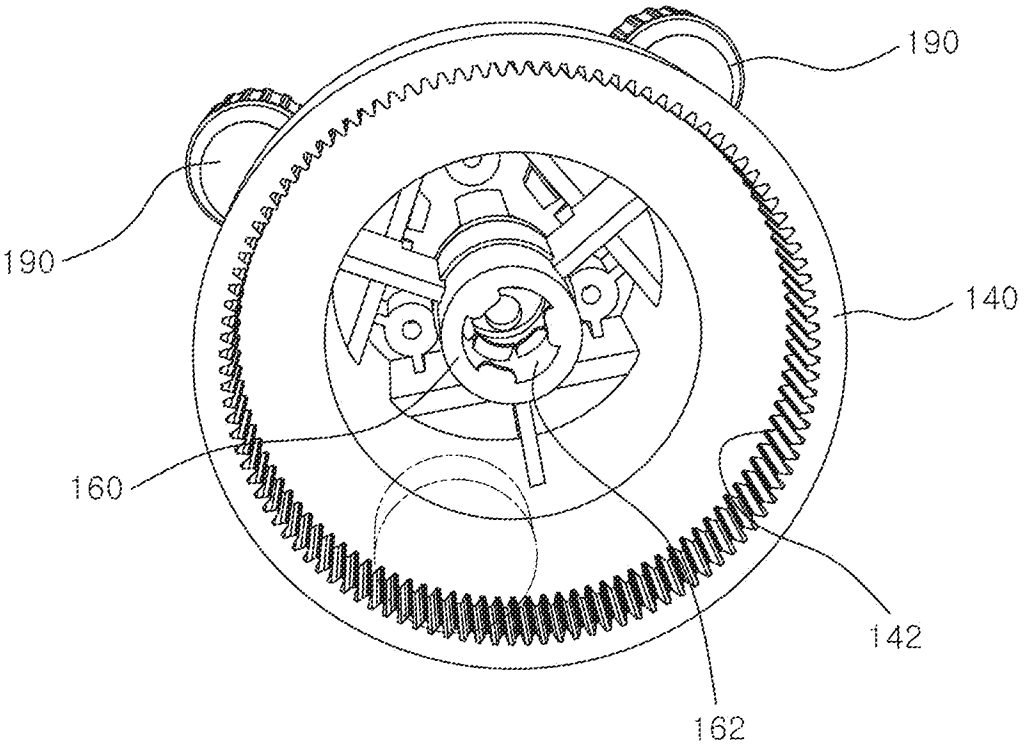
FIG. 4 is a bottom perspective view illustrating a nozzle structure of the desk type device for spraying a liquid chemical according to the inventive concept.
Figure 5:
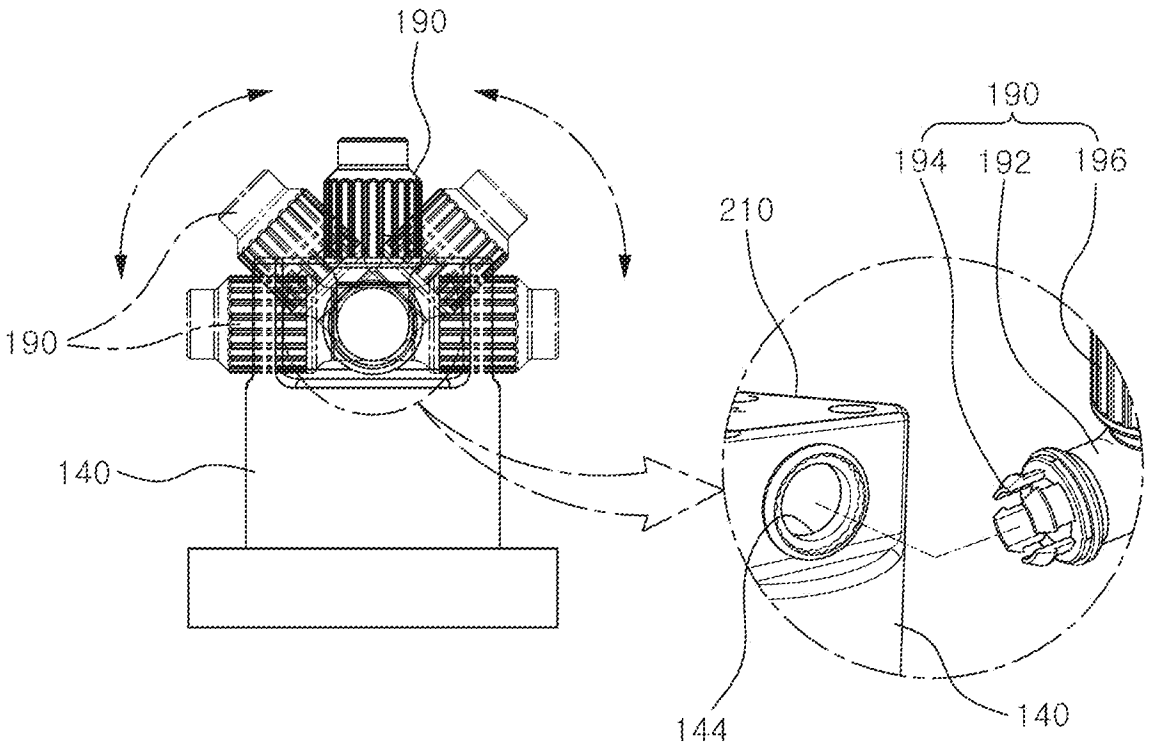
FIG. 5 is a diagram illustrating a nozzle of the desk type device for spraying a liquid chemical according to the inventive concept.
Figure 6:
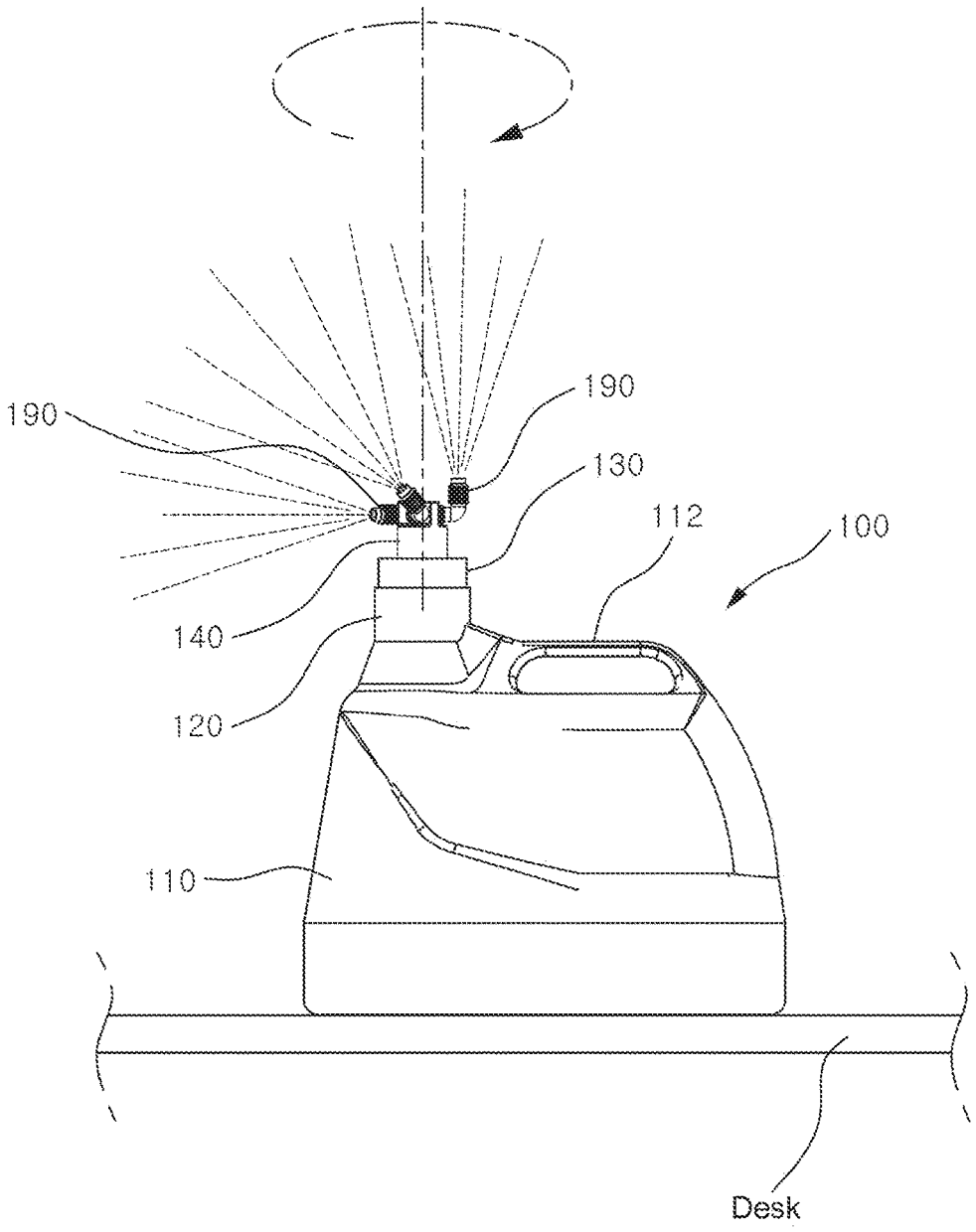
FIG. 6 is a side view illustrating a state in which the desk type device for spraying a liquid chemical according to the inventive concept sprays a liquid chemical.

FIG. 1 is an exploded perspective view illustrating a desk type liquid chemical spraying device according to the inventive concept. FIG. 2 is a perspective view illustrating the desk type liquid chemical spraying device according to the inventive concept. FIG. 3 is a longitudinal sectional view illustrating a nozzle structure of the desk type liquid chemical spraying device according to the inventive concept. FIG. 4 is a bottom perspective view illustrating a nozzle structure of the desk type liquid chemical spraying device according to the inventive concept. FIG. 5 is a diagram illustrating a nozzle of the desk type liquid chemical spraying device according to the inventive concept. FIG. 6 is a side view illustrating a state in which the desk type liquid chemical spraying device according to the inventive concept sprays a liquid chemical.

As illustrated in FIGS. 1 to 6, the desk type liquid chemical spraying device 100 according to the inventive concept is a technology of spraying a liquid chemical to four sides at up to 360 degrees while a nozzle installation member 140 is rotated by a driving motor 150 by locating the liquid chemical spraying device 100 in a flat place such as a desk and applying electric power. That is, the desk top device is a technology of automatically spraying a liquid chemical to four sides in a specific range by locating the desk top device on a flat desk instead of spraying a liquid chemical to an operation range while the operator carries the liquid chemical spraying device 100.

The desk type liquid chemical spraying device 100 according to the inventive concept includes a spraying case 110 in which a liquid chemical container for storing a liquid chemical is provided in the interior thereof and having a flat bottom surface such that the spraying case 110 is seated in a flat place, a fixing support member 120 integrally formed with one side of an upper part of the spraying case 110 and having an open-topped structure, a rotation support member 130 fixedly installed through an upper part of the fixing support member 120 and having an open-topped and an open-bottomed tubular structure, an open-topped and an open-bottomed nozzle installation member 140 having an inner race gear 142 installed on an upper side of the rotation support member 130 to be rotatable and formed on an inner peripheral surface of a lower side of the nozzle installation member 140 and a plurality of nozzle coupling holes 144 formed on an outer peripheral surface of an upper part of the nozzle installation member 140, a driving motor 150 fixedly installed on an inner side of the rotation support member 130 and in which a driving gear 152 enmeshed with the inner race gear 142 of the nozzle installation member 140 is provided on a driving shaft, a liquid chemical supply hose coupling member 160 fixedly installed on an inner peripheral surface of the nozzle installation member 140 through supports of 3 points or more and having a vertical hose coupling hole 162 at the center thereof, a liquid chemical supply hose 170 inserted into the hose coupling hole 162 of the liquid chemical supply hose coupling member 160 through the fixing support member 120 of the spraying case 110 and coupled to an inner peripheral surface of the hose coupling hole 162 by a bearing 172 coupled onto an outer peripheral surface of an upper end thereof, a liquid chemical branch member 180 coupled and fixed to an upper end of the hose coupling hole 162 of the liquid chemical hose coupling member 160, forming a space between the liquid chemical branch member 180 and an upper end of the liquid chemical supply hose 170, and in which a plurality of branch holes 182 corresponding to the number of the nozzle coupling holes 144 pass through the liquid chemical branch member 180, a plurality of liquid chemical ejecting nozzles 190 detachable coupled to the nozzle coupling holes 144 of the nozzle installation member 140, respectively, to spray a liquid chemical, and a plurality of liquid chemical branch hose 200 for supplying a liquid chemical to the liquid chemical ejecting nozzles 190 from the branch holes 182 of the liquid chemical branch members 180, respectively.

If the desk type liquid chemical spraying device 100 according to the inventive concept is operated by applying a voltage, a liquid chemical stored in the liquid chemical container in the interior of the spraying case 110 is supplied from the liquid chemical container to the liquid chemical supply hose 170 by driving a blower for supplying a liquid chemical through a pneumatic pressure or a pump for supplying a liquid chemical through pumping. In this way, the liquid chemical supplied through the liquid chemical supply hose 170 is sprayed through the liquid chemical ejecting nozzle via the liquid supply hose coupling member 160, the liquid chemical branch member 180, and the liquid chemical branch hose 200.

Meanwhile, as described above, while the liquid chemical supplied through the liquid chemical supply hose 170 is sprayed through the liquid chemical ejecting nozzle 190 via the liquid chemical supply hose coupling member 160, the liquid chemical branch member 180, and the liquid chemical branch hose 200, the nozzle installation member 140 may be rotated to the left and right sides through driving of the driving motor 150. Then, if the nozzle installation member 140 is rotated, the liquid chemical may be ejected to four sides at an angle of up to 360 degrees while the liquid chemical ejecting nozzle 190 itself is rotated together with the nozzle installation member 140 with the liquid chemical ejecting nozzle 190 being fixed to the nozzle installation member 140.

That is, in the configuration of the desk type liquid chemical spraying device 100 according to the inventive concept, the liquid chemical nozzles 190 installed in the nozzle coupling holes 144 of the nozzle installation member 140 is installed to be rotatable vertically to adjust a spraying angle of the liquid chemical but is fixed if the angles of the liquid chemical nozzles 190 are adjusted by the operation, the nozzle installation member 140 may spray the liquid chemical to four sides at up to 360 degrees as it is rotated to the left and right sides by the driven driving motor 150.

The elements of the desk type liquid chemical spraying device 100 according to the inventive concept will be described in detail. Further, the spraying case 110 according to the inventive concept is positioned on a flat desk, and the spraying case 110 is provided in the interior of the liquid chemical container (not illustrated) for storing a liquid chemical and has a flat bottom surface such that the spraying case 110 is seated in a flat place.

Meanwhile, not only a liquid chemical container (not illustrated) for storing a liquid chemical but also a supply unit for compulsorily supplying a liquid chemical stored in the liquid chemical container are provided in the interior of the above-mentioned spraying case 110. That is, the liquid chemical is first stored in and first supplied from the spraying case 110.

As mentioned above, the supply unit provided in the interior of the spraying case 110 to compulsorily supply a liquid chemical stored in the liquid chemical container may include a blower for supplying the liquid chemical through a pneumatic pressure or a pump for supplying the liquid chemical through pumping. The configuration of the blower for supplying the liquid chemical through a pneumatic pressure or the pump for supplying the liquid chemical through pumping is generalized in the field of a liquid chemical sprayer, and a detailed description thereof will be omitted.

In addition, the above-mentioned spraying case 110 further includes a carrying handle 112 provided on one side of an upper part of the spraying case 110 to allow a user to carry the liquid chemical spraying device 100, and includes an on/off switch 114 for switching on and off driving of the blower or the pump that is a supply unit for compulsorily supplying the liquid chemical stored in the liquid chemical container and switching on and off driving of the driving motor 150.

Next, the fixing support member 120 according to the inventive concept is adapted to fix and support the rotation support member 130 installed on the upper side, and the fixing support member 120 is integrally formed on one side of an upper part of the spraying case 110 as illustrated in FIGS. 1, 2, 3, and 6, and has an open-topped structure.

Because the liquid chemical spraying device 100 according to the inventive concept is of a desk type, the fixing support member 120 provided on one side of an upper part of the spraying case 110 is formed towards the upper side, and because the liquid chemical supply hose 170, which will be described below, has to extend upwards, the fixing support member 120 has to be an open-topped structure.

Next, the rotation support member 130 according to the inventive concept is adapted to support the nozzle installation member 140 installed upwards, and the rotation support member 130 is fixedly installed through an upper part of the fixing support member 120 as illustrated in FIGS. 1, 2, 3, and 6 and has an open-topped and bottom-topped tubular body structure.

Because the rotation support member 130 having an open-topped and bottom-topped tubular body structure as described above has a structure in which the rotation support member 130 is fixedly installed in an upper part of the fixing support member 120 such that the liquid chemical supply hose 170, which will be described below, passes through the rotation support member 130 vertically, the rotation support member 130 has to have an open-topped and bottom-topped tubular body structure. The driving motor 150, which will be described below, is fixedly installed in the interior of the rotation support member 130.

Next, the nozzle installation member 140 according to the inventive concept has a plurality of liquid chemical ejecting nozzles 190 to spray a liquid chemical to four sides at an angle of up to 360 degrees through rotation, and the nozzle installation member 140 is installed on an upper side of the rotation support member 130 to be rotatable as illustrated in FIGS. 1 to 6 and has an open-topped and bottom-topped structure having an inner race gear 142 formed on an inner peripheral surface of a lower side thereof and a plurality of nozzle coupling holes 144 formed on an outer peripheral surface of an upper part thereof.

The above-mentioned nozzle installation member 140 is configured such that the liquid chemical sprayed through the liquid chemical ejecting nozzles 190 coupled to the nozzle coupling holes 144 of the nozzle installation member 140, respectively is sprayed to four sides at an angle of up to 360 degrees while the nozzle installation member 140 is rotated through driving of the driving motor 150, and as illustrated in FIGS. 3 and 4, the nozzle installation member 140 is rotated through rotation of the driving gear 152 enmeshed with the inner race gear 142 to spray the liquid chemical to four sides at an angle of up to 360 degrees.

Further, in the configuration of the above-mentioned nozzle installation member 140, the inner race gear 142 refers to a gear having a structure in which gear teeth are formed on an inner peripheral surface of a lower side of the nozzle installation member 140, and because the driving gear 152 enmeshed with the inner race gear 142 is enmeshed with the inner race gear 142 on an inner peripheral surface of a lower side of the nozzle installation member 140, a spatial utility is excellent.

Meanwhile, a cover cap 210 configured to cover an opened structure is further provided at an opened upper end of the above-mentioned nozzle installation member 140. That is, as illustrated in FIGS. 2 and 3, the cover cap 210 is installed at an upper end of the nozzle installation member 140 having an opened upper end to cover the opened structure, thereby preventing introduction of foreign substances.

Next, the driving motor 150 according to the inventive concept is driven by applying a voltage to rotate the nozzle installation member 140, and as illustrated in FIGS. 2 and 3, the driving motor 150 is fixedly installed on an inside of the rotation support member 130 such that the driving gear 152 enmeshed with the inner race gear 142 of the nozzle installation member 140 is provided on a driving shaft to rotate the nozzle installation member 140, so that the liquid chemical may be sprayed to four sides at an angel of up to 360 degrees.

The above-mentioned driving motor 150 may have a structure that is rotated in one direction, and may have a structure that may be rotated to the left and right sides in forward and reverse directions. Because the liquid chemical spraying device 100 according to the inventive concept is a technology of automatically spraying a liquid chemical to four sides at an angle of up to 360 degrees, it is preferable that a driving motor having a structure that is rotated in one direction is used.

Next, the liquid chemical supply hose coupling member 160 according to the inventive concept is adapted to install the liquid chemical supply hose 170, which will be described below, at the center of the nozzle installation member 140, and as illustrated in FIGS. 3 and 4, the liquid chemical supply hose coupling member 160 is fixedly installed on an inner peripheral surface of the nozzle installation member 140 through support of 3 points or more, and a hose coupling hole 162 is vertically formed at the center of the liquid chemical supply hose coupling member 160.

The liquid chemical supply hose coupling member 160 configured as described above has three or more legs at a regular interval on an outer peripheral surface of the tubular body having the hose coupling hole 162. Then, the diameter of the circumference formed by the legs is a diameter corresponding to the inner diameter of the nozzle installation member 140 and is interference-fitted when the legs are installed inside the nozzle installation member 140.

Next, the liquid chemical supply hose 170 according to the inventive concept is adapted to supply the liquid chemical stored in the liquid chemical container in the interior of the spraying case 110 upwards, and as illustrated in FIG. 3, the liquid chemical supply hose 170 is inserted into the hose coupling hole 162 of the liquid chemical supply hose coupling member 160 through the fixing support member 120 of the spraying case 110 and is coupled to an inner peripheral surface of the hose coupling hole 162 by a bearing 172 coupled onto an outer peripheral surface of an upper end thereof.

The liquid chemical supply hose 170 configured as described above extends upwards from the liquid chemical container in the interior of the spraying case 110 to be inserted into the hose coupling hole 162 of the liquid chemical supply hose coupling member 160. Accordingly, the liquid chemical supply hose 170 has a fixed structure that is not rotatable, and only the nozzle installation member 140 is rotated by the bearing 172.

That is, as described above, because the bearing 172 installed on an outer peripheral surface of an upper end of the liquid chemical supply hose 170 is coupled to an inner peripheral surface of the hose coupling hole 162 such that the liquid chemical supply hose coupling member 160 is integrally coupled to the nozzle installation member 140, the nozzle installation member 140 is rotated about the fixed liquid chemical supply hose 170 by the bearing 172 through driving of the driving motor 150.

Next, the liquid chemical branch member 180 according to the inventive concept is adapted to branch the liquid chemical supplied upwards through the liquid chemical supply hose 170 to supply the liquid chemical, and as illustrated in FIG. 3, the liquid chemical branch member 180 is fixedly coupled to an upper end of the hose coupling hole 162 of the liquid chemical supply hose coupling member 160 to form a space between the liquid chemical branch member 180 and an upper end of the liquid chemical supply hose 170 and a plurality of branch holes 182, the number of which corresponds to the number of the nozzle coupling holes 144, pass through the liquid chemical branch member 180 vertically.

The liquid chemical branch member 180 configured as described above is fixedly coupled to upper ends of the hose coupling holes 162 of the liquid chemical supply hose coupling member 160 to form a space between the liquid chemical branch member 180 and an upper end of the liquid chemical supply hose 170 so that the liquid chemical supplied to the space through the liquid chemical supply hose 170 is branched to a plurality of directions through the branch holes 182.

Meanwhile, as illustrated in FIGS. 2 and 3, a plurality of branch hose fixing pieces 184 for fixing the liquid chemical branch hoses 200, which will be described below, through recesses are formed at an upper end of the liquid chemical branch member 180.

Next, the liquid chemical ejecting nozzles 190 according to the inventive concept is adapted to spray a liquid chemical, and as illustrated in FIGS. 1 to 6, the liquid chemical ejecting nozzles 190 are detachably coupled to the nozzle coupling holes 144 of the nozzle installation member 140 to spray the liquid chemical.

The liquid chemical ejecting nozzle 190 configured as described above includes a bent nozzle tubular body 192, a coupling hook 194 formed at one end of the nozzle tubular body 192 and detachably coupled onto the corresponding nozzle hole 144 of the nozzle installation member 140, and a nozzle cap 196 screw-coupled to an opposite end of the nozzle tubular body 192 and having a nozzle 196-1 for spraying the liquid chemical at the center thereof.

Meanwhile, the liquid chemical ejecting nozzle 190 configured as described above is detachably coupled onto the nozzle hole 144 of the nozzle installation member 140 through the coupling hook 194, and if a part in which the nozzle cap 196 is rotated to the left and right sides, a part of the coupling hook 194 is rotated to the left and right sides such that an angle of the nozzle cap 196 constituting the liquid chemical ejecting nozzle 190 may be adjusted.

Next, the liquid chemical branch hose 200 according to the inventive concept is adapted to branch a liquid chemical from the branch holes 180 of the liquid chemical branch members 180 to the liquid chemical ejecting nozzles 190 to supply the liquid chemical, and as illustrated in FIG. 3, the liquid chemical branch hose 200 supply the liquid chemical from the branch holes 182 of the liquid chemical branch members 180 to the liquid chemical ejecting nozzles 190.

Lower ends of the liquid chemical branch hose 200 configured as described above are coupled to the branch holes 182 of the liquid chemical branch members 180 and are connected to the centers of the coupling hooks 194 at ends of the nozzle tubular bodies 192 through the recesses between the branch hose fixing pieces 184 of the liquid chemical branch members 180 so that the liquid chemical supplied through the liquid chemical supply hose 170 and the liquid chemical branch members 180 may be branched to the liquid chemical ejecting nozzles 190 to be supplied to the liquid chemical ejecting nozzles 190, respectively.

As described above, the technology of the inventive concept has an advantage of automatically spraying a liquid chemical in a wide range by locating the liquid chemical spraying device in a flat place such as a ground surface or a desk by installing a plurality of nozzles for spraying a chemical liquid to the upper side of the spraying case 110 through the nozzle installation member 140 and spraying the liquid chemical to four sides while the nozzle installation member 140 is rotated.

According to the technology of the inventive concept, a liquid chemical may be sprayed more easily in a wider range by installing the plurality of nozzles for spraying a liquid chemical on an upper side of the spraying case through the nozzle structure, and by spraying the liquid chemical to four sides while the nozzle structure is rotated so that the liquid chemical spraying device may be located in a flat place such as a ground surface or a desk.

Further, according to the technology of the inventive concept, insecticides, control of insect pests, disinfection may be performed more easily by automatically spraying the liquid chemical in a specific range and the liquid chemical may be prevented from penetrating into the human body through skin or respiratory organs to poison the liquid chemical by automatically spraying the liquid chemical and interrupting an influence of the liquid chemical on the human body.

The inventive concept is not limited to the above-described embodiment, and may be variously modified within a range allowed by the technical spirit of the inventive concept.

What is claimed is:

1. A desk type liquid chemical spraying device, comprising:

a spraying case in which a liquid chemical container for storing a liquid chemical is provided in the interior thereof and having a flat bottom surface such that the spraying case is seated in a flat place;

a fixing support member integrally formed with one side of an upper part of the spraying case and having an open-topped structure;

a rotation support member fixedly installed through an upper part of the fixing support member and having an open-topped and an open-bottomed tubular structure;

an open-topped and an open-bottomed nozzle installation member having an inner race gear installed on an upper side of the rotation support member to be rotatable and formed on an inner peripheral surface of a lower side of the nozzle installation member and a plurality of nozzle coupling holes formed on an outer peripheral surface of an upper part of the nozzle installation member;

a driving motor fixedly installed on an inner side of the rotation support member and in which a driving gear enmeshed with the inner race gear of the nozzle installation member is provided on a driving shaft;

a liquid chemical supply hose coupling member fixedly installed on an inner peripheral surface of the nozzle installation member through supports of 3 points or more and having a vertical hose coupling hole at a center of the vertical hose coupling hole coupling member;

a liquid chemical supply hose inserted into the vertical hose coupling hole of the liquid chemical supply hose coupling member through the fixing support member of the spraying case and coupled to an inner peripheral surface of the vertical hose coupling hole by a bearing coupled onto an outer peripheral surface of an upper end thereof;

a liquid chemical branch member coupled and fixed to an upper end of the vertical hose coupling hole of the liquid chemical hose coupling member, forming a space between the liquid chemical branch member and an upper end of the liquid chemical supply hose, and in which a plurality of branch holes corresponding to the number of the nozzle coupling holes vertically pass through the liquid chemical branch member;

a plurality of liquid chemical ejecting nozzles detachable coupled to the nozzle coupling holes of the nozzle installation member, respectively, to spray a liquid chemical; and a plurality of liquid chemical branch hoses for supplying a liquid chemical to the liquid chemical ejecting nozzles from the branch holes of the liquid chemical branch members, respectively.

2. The desk type liquid chemical spraying device of claim 1, further comprising:

a carrying handle allowing a user to grip one side of an upper part of the spraying case to carry the desk type liquid chemical spraying device.

3. The desk type liquid chemical spraying device of claim 1, further comprising:

a cover cap installed at an upper end of the nozzle installation member to cover an opening structure.

4. The desk type liquid chemical spraying device of claim 1, wherein the liquid chemical ejecting nozzle comprises:

a bent nozzle tubular body;

a coupling hook formed at one end of the nozzle tubular body and detachably coupled onto the corresponding nozzle coupling hole of the nozzle installation member; and a nozzle cap screw-coupled to an opposite end of the nozzle tubular body and having a nozzle configured to spray a liquid chemical at a center of the nozzle cap.

5. The desk type liquid chemical spraying device of claim 4, wherein the bearing coupled onto an outer peripheral surface of an upper end of the liquid chemical supply hose is configured to rotate the nozzle installation member about the liquid chemical supply hose that is fixedly installed.

6. The desk type liquid chemical spraying device of claim 4, wherein the liquid chemical ejecting nozzle sprays a liquid chemical in a horizontal direction of a vertical upper rotor by vertically adjusting an angle of the liquid chemical ejecting nozzle.

7. The desk type liquid chemical spraying device of claim 4, wherein the liquid chemical in a liquid chemical container in the interior of the spraying case is supplied by a blower configured to supply the liquid chemical through a pneumatic pressure or a pump configured to supply the liquid chemical through pumping.

8. The desk type liquid chemical spraying device of claim 2, wherein the liquid chemical ejecting nozzle comprises:

a bent nozzle tubular body;

a coupling hook formed at one end of the nozzle tubular body and detachably coupled onto the corresponding nozzle coupling hole of the nozzle installation member; and a nozzle cap screw-coupled to an opposite end of the nozzle tubular body and having a nozzle configured to spray a liquid chemical at a center of the nozzle cap.

9. The desk type liquid chemical spraying device of claim 8, wherein the bearing coupled onto an outer peripheral surface of an upper end of the liquid chemical supply hose is configured to rotate the nozzle installation member about the liquid chemical supply hose that is fixedly installed.

10. The desk type liquid chemical spraying device of claim 8, wherein the liquid chemical ejecting nozzle sprays a liquid chemical in a horizontal direction of a vertical upper rotor by vertically adjusting an angle of the liquid chemical ejecting nozzle.

11. The desk type liquid chemical spraying device of claim 8, wherein the liquid chemical in a liquid chemical container in the interior of the spraying case is supplied by a blower configured to supply the liquid chemical through a pneumatic pressure or a pump configured to supply the liquid chemical through pumping.

12. The desk type liquid chemical spraying device of claim 3, wherein the liquid chemical ejecting nozzle comprises:

a bent nozzle tubular body;

a coupling hook formed at one end of the nozzle tubular body and detachably coupled onto the corresponding nozzle coupling hole of the nozzle installation member; and a nozzle cap screw-coupled to an opposite end of the nozzle tubular body and having a nozzle configured to spray a liquid chemical at a center of the nozzle cap.

13. The desk type liquid chemical spraying device of claim 12, wherein the bearing coupled onto an outer peripheral surface of an upper end of the liquid chemical supply hose is configured to rotate the nozzle installation member about the liquid chemical supply hose that is fixedly installed.

14. The desk type liquid chemical spraying device of claim 12, wherein the liquid chemical ejecting nozzle sprays a liquid chemical in a horizontal direction of a vertical upper rotor by vertically adjusting an angle of the liquid chemical ejecting nozzle.

15. The desk type liquid chemical spraying device of claim 12, wherein the liquid chemical in a liquid chemical container in the interior of the spraying case is supplied by a blower configured to supply the liquid chemical through a pneumatic pressure or a pump configured to supply the liquid chemical through pumping.

* * * * *